US007364157B2

(12) United States Patent
Iida

(10) Patent No.: US 7,364,157 B2
(45) Date of Patent: Apr. 29, 2008

(54) COMPACT BACKNOTE DISPENSING DEVICE WITH BANKNOTE LENGTH SENSOR

(75) Inventor: Joji Iida, Hachiouji (JP)

(73) Assignee: Asahi Seiko Co., Ltd., Tokyo (JP)

( * ) Notice: Subject to any disclaimer, the term of this patent is extended or adjusted under 35 U.S.C. 154(b) by 553 days.

(21) Appl. No.: 10/647,734

(22) Filed: Aug. 25, 2003

(65) Prior Publication Data

US 2004/0108648 A1 Jun. 10, 2004

(30) Foreign Application Priority Data

Aug. 27, 2002 (JP) ..... 2002-247807

(51) Int. Cl.
*B65H 7/02* (2006.01)

(52) U.S. Cl. ..... 271/265.02; 271/265.01; 209/534; 209/552

(58) Field of Classification Search ..... 271/265.01, 271/265.02, 10.11, 10.13, 188; 209/534, 209/586, 659, 552; 194/206
See application file for complete search history.

(56) References Cited

U.S. PATENT DOCUMENTS

| | | | | |
|---|---|---|---|---|
| 3,795,395 | A * | 3/1974 | Ransom et al. | 271/4.06 |
| 3,907,278 | A | 9/1975 | Jaton | |
| 3,937,453 | A * | 2/1976 | Hickey et al. | 271/4.09 |
| 4,020,972 | A * | 5/1977 | Lundblad | 221/13 |
| 4,095,781 | A * | 6/1978 | Kistner et al. | 271/12 |
| 4,154,437 | A | 5/1979 | Butcheck et al. | |
| 4,355,797 | A | 10/1982 | Graef et al. | |
| 4,615,350 | A | 10/1986 | Boudville | |
| 4,625,870 | A * | 12/1986 | Nao et al. | 209/534 |
| 4,895,358 | A | 1/1990 | Kawasaki | |
| 4,972,958 | A * | 11/1990 | Ito et al. | 209/534 |
| 5,310,173 | A | 5/1994 | Martinez | |
| 5,535,894 | A | 7/1996 | Ishiwata | |
| 5,553,320 | A * | 9/1996 | Matsuura et al. | 235/379 |
| 5,607,352 | A | 3/1997 | Tani | |
| 5,711,704 | A | 1/1998 | Hughes et al. | |
| 6,006,989 | A * | 12/1999 | Ademmer et al. | 235/379 |
| 6,189,881 | B1 * | 2/2001 | Bolton et al. | 271/9.04 |
| 6,536,761 | B2 * | 3/2003 | Mochizuki et al. | 271/208 |
| 6,715,671 | B2 * | 4/2004 | Abe et al. | 235/379 |

FOREIGN PATENT DOCUMENTS

| | | |
|---|---|---|
| JP | 06-092491 | 5/1994 |
| JP | 6-43767 | 6/1994 |
| JP | 6-190138 | 7/1994 |
| JP | 11-25309 | 1/1999 |
| JP | 11-353532 | 12/1999 |
| JP | 2002-92700 | 3/2002 |

* cited by examiner

*Primary Examiner*—Patrick Mackey
*Assistant Examiner*—Kaitlin S Joerger

(57) ABSTRACT

A compact banknote dispensing device including a storage section for storing one or more banknotes, a discharging unit driven by a first motor for discharging banknotes one-by-one at a first speed, and a transporting unit driven by a second motor for receiving the discharged banknotes from the discharging unit and transporting the discharged banknotes at a second speed where the second speed is faster than the first speed, the one-way clutch permitting the discharged banknote to be continuously drawn at the second speed without damaging the discharged banknote. The compact banknote dispensing device includes a length sensor disposed about a U-shaped guiding unit and connected to a control unit. The control unit determines whether the transported banknote is acceptable for dispensing and is transported properly. The compact banknote dispensing device turns off the motors in an error condition and sounds an audible alarm.

19 Claims, 9 Drawing Sheets

COMPACT BACKNOTE DISPENSING DEVICE WITH BANKNOTE LENGTH SENSOR

CROSS-REFERENCE TO RELATED APPLICATION

This application is based on an application number 2002-247807 filed in Japan, dated Aug. 27, 2002.

FIELD OF THE INVENTION

The present invention is related to a banknote dispensing device. More particularly, the present invention is related to a compact banknote dispensing device with a banknote length sensor. The dispensing device transports a banknote faster than the discharge speed from an internal banknote supply storing section without damaging the banknote.

DESCRIPTION OF RELATED ART

A banknote dispensing device may be included together with a banknote accepting device and a token dispensing device to comprise a token purchasing station for use in a gaming environment. Gaming devices are often of a standard size and it is desirable for a token purchasing station to be of a corresponding size with the gaming devices. Often a token purchasing station will be placed between gaming devices and it is desirable that the token purchasing station should have a similar profile.

Given these constraints, a compact banknote dispensing device with sophisticated features to determine the denomination of banknotes prior to dispensing is needed. The compact banknote dispensing device should be narrow in width, while conforming to the depth and height profile of adjacent gaming devices.

Common dimensions for such a desirable compact dispensing device are limited to 810 mm height, 100 mm width, and 240 mm depth. However, the size of the dispensed banknote has an effect on the depth of the dispensing device. A longer banknote would previously require the depth of the dispensing device to become longer.

In some regions, a larger (longer) banknote is used to convey a larger denomination value. Hence, the size limitations on the banknote automatically limit the denomination value that may be dispensed which would ensure that only lower value denominations are used for the dispensing device.

This lower value denomination may be undesirable because the number of banknotes stored in the dispensing device is limited, and dispensing a higher amount would require the banknote dispensing device to dispense a larger number of banknotes, and thereby deplete the banknote supply more rapidly.

The addition of sensors to determine the validity of the banknotes prior to dispensing also contributed to the increasing size of the dispensing device, requiring a dispensing path of a required length to allow the dispensing device to accurately measure some artifact of the banknote prior to dispensing the banknote, in order to avoid dispensing erroneous banknotes.

Commonly, the length sensor would be located over a passage length of 1.5 times the length of the largest expected banknote size. This caused the a previous banknote dispensing device to be larger in size as disclosed in Japanese Laid Open Patent 11-353532 and 2002-092700.

Previously, when a banknote was discharged or let off from a banknote supply storing section at one speed and then taken up by a transporting unit at a higher speed, the banknote would be damaged due to the difference in speeds. Usually, the damage to the banknote occurs because the drive mechanisms, such as feed rollers, that contact the banknote in both the banknote supply storing section and the banknote transporting unit are simultaneously engaged with the banknote while driving the banknote at different speeds. This difference in speeds may apply a shearing force to the banknote thereby damaging the banknote.

One attempt to address this problem has been to provide a drive mechanism with a projection on the periphery of the drive mechanism. This projection is used to positively engage a banknote and move it in the direction of the transport unit feed rollers. However, the drive mechanism with the projection must not have contact with the banknote at the point the banknote engages with the transport unit feed rollers since the projection would cause significant damage to the banknote.

Instead, the drive mechanism with the projection only engages the banknote for a portion of the travel, and allows the banknote to continue for a period of time before engaging with the transport unit feed roller. This period of time where the banknote is not positively engaged, with either the drive mechanism with a projection or the feed rollers of the transport unit, allows the banknote to travel freely and may allow the banknote to stall or become misaligned.

In an attempt to reduce the time the banknote is not positively driven, another device including a drive mechanism with a clutch was used. The clutch mechanism determines when the drive mechanism is driving the banknote and can be declutched, or disengaged, from driving prior to the moment the banknote arrives at the transporting feed rollers.

This method requires a very precise control of the declutching so as to avoid any time when the banknote is both driven simultaneously by the drive mechanism of the banknote supply storing section and being pulled by the feed rollers of the banknote transport unit. If the declutching occurs too late, the banknote may be damaged as discussed above. If the declutching occurs too early, the banknote may stall or become misaligned causing jamming or other malfunction.

Finally, a compromise method was used that allows a limited freedom to advance the banknote as it is discharged by a banknote supply storing section and then pulled at a higher speed by a transport unit such as that described in the Japanese laid open patent 6-92491. In this case, a drive shaft with a radial projection drives a feed roller in one direction of rotation. The projection is within a cavity region within the feed roller so that the feed roller may be advanced in the direction of rotation a limited amount, causing the projection to loose contact with the driven edge. This allows a limited amount of rotational freedom where the disengagement of the projection with the feed roller allows the banknote to be advanced. This method suffers from the obvious limitation that the feed roller only allows a limited amount of advancement of only ¼ turn in the cited reference.

SUMMARY OF THE INVENTION

The present invention provides a compact banknote dispensing device with a length sensor for determining the length of a banknote prior to dispensing. The compact banknote dispensing device includes a banknote supply storing section for storing banknotes, a banknote discharging unit for discharging the banknotes at a first speed, a banknote transporting unit for transporting the discharged banknote at a second, higher speed, a U-shaped banknote guiding unit, a diverting unit for diverting unacceptable discharged banknotes to a rejected banknote storing section, a package dispensing unit to dispense the acceptable discharged banknotes, and a control unit for receiving signals from and controlling the actions of the dispensing device.

The banknote supply storing section retains the stored banknotes at an angle measured with the horizontal. This allows the banknote storing section have a smaller profile in the depth dimension for the same size banknotes as was previously possible. Correspondingly, the angled storing allows the banknote supply storing section to retain larger denomination (longer) banknotes in the same depth dimension as was previously possible.

The length sensor includes two banknote sensors disposed on a U-shaped transporting path. The U-shape of the transporting path allows the transported banknote to traverse a longer linear distance, while the actual depth required is less due to the folding over of the transporting path into the U-shape. This U-shape transport path and the angled banknote storing section provide the compact size of the dispensing device.

The length sensor outputs signals to a control unit that interprets the signals to determine whether the dispensed banknote is acceptable. An unacceptable banknote is discharged to a rejected banknote storing section, while the acceptable banknotes are discharged to a temporary storing section. Once a predetermined number of banknotes are accumulated in the temporary storing section, they are all dispensed at one time to a dispensing slot from which a user can grasp.

The banknote dispensing device utilizes a one-way clutch for transferring a banknote from a banknote supply storage section at one speed to a banknote transporting unit at a second, higher speed while avoiding damage to the banknote due to this difference in speed in the transfer.

The banknotes are discharged from the banknote supply storing section by the banknote discharge unit using a feed roller driven by a one-way clutch at a first predetermined speed. The discharged banknote is received by the banknote transporting device that pulls the discharged banknote at a second predetermined speed which is faster than the first speed. When the banknote is pulled at the second, faster speed, the one-way clutch driving the feed roller in the discharge unit automatically allows the banknote to be continuously pulled at the faster speed without damaging the banknote.

The dispensing device includes five sensors, three motors, and a solenoid (magnetically actuated) device. The first sensor detects the banknote as it is received by the transporting device. The second sensor detects the presence of the discharged banknote in as it travels past the U-shaped guiding unit. The third sensor detects the presence of the banknote at the rejected banknote discharge point from the dispensing device. The fourth sensor detects the presence of the banknote at the normal banknote discharge point. The fifth sensor detects the accumulated banknotes as they are dispensed from the dispensing device. The first motor drives the discharging unit while the second motor drives the transporting unit. The solenoid actuates a diverting board for selectively diverting rejected banknotes into a rejected banknote storing section. The third motor drives the dispensing unit.

The dispensing device includes a control unit that interprets the signals from the sensors to determine whether the banknote has been discharged and transported properly. The control unit outputs signals to activate the motors and the solenoid. When an error condition is detected, the motors are stopped and an audible alarm is sounded.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the intention is intended to cover alternatives, modifications and equivalents, which may be included within the spirit and scope of the invention as defined by the appended claims.

Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

Figure 1:
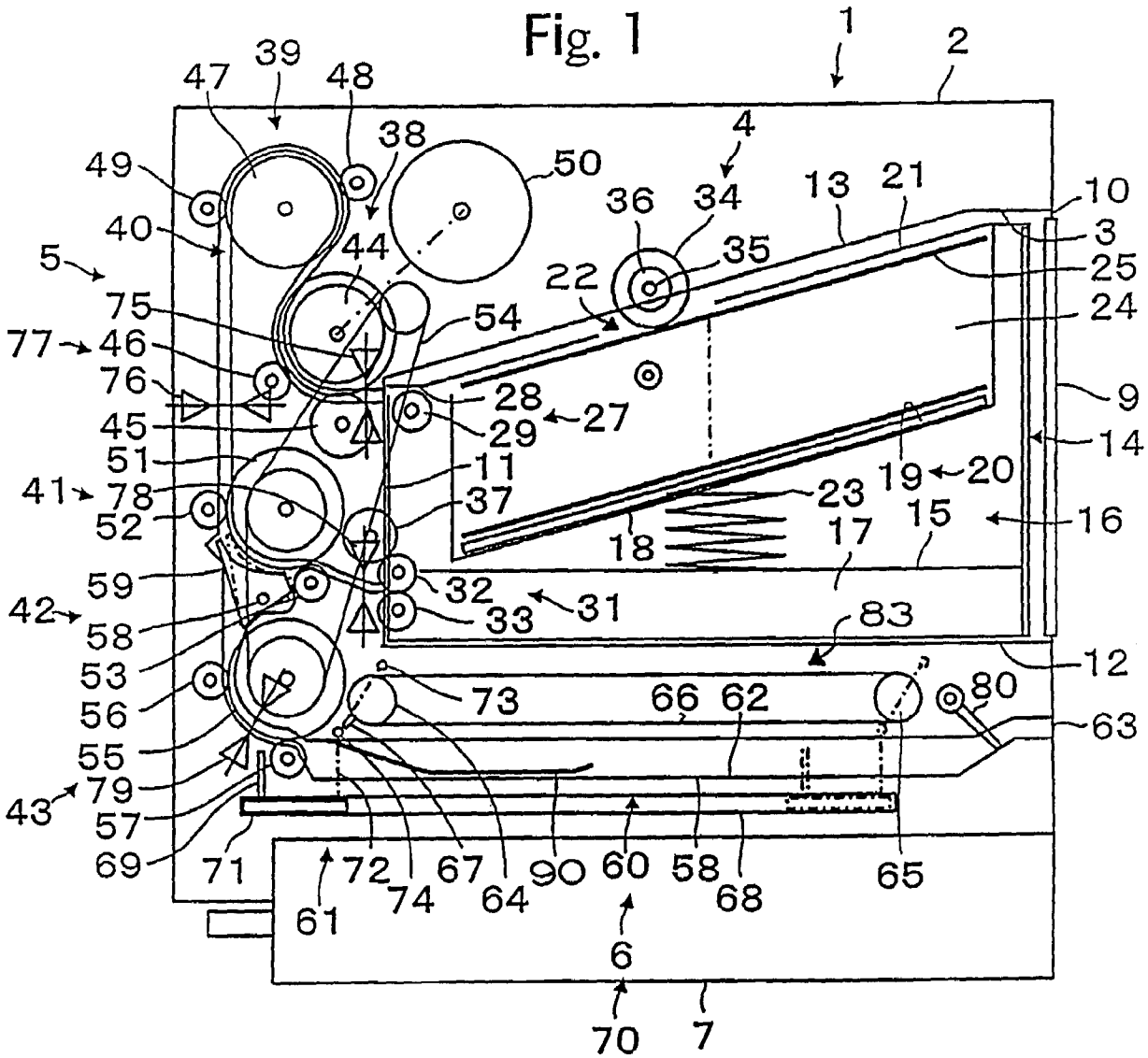
FIG. 1 shows an embodiment of the present invention.
Figure 2:
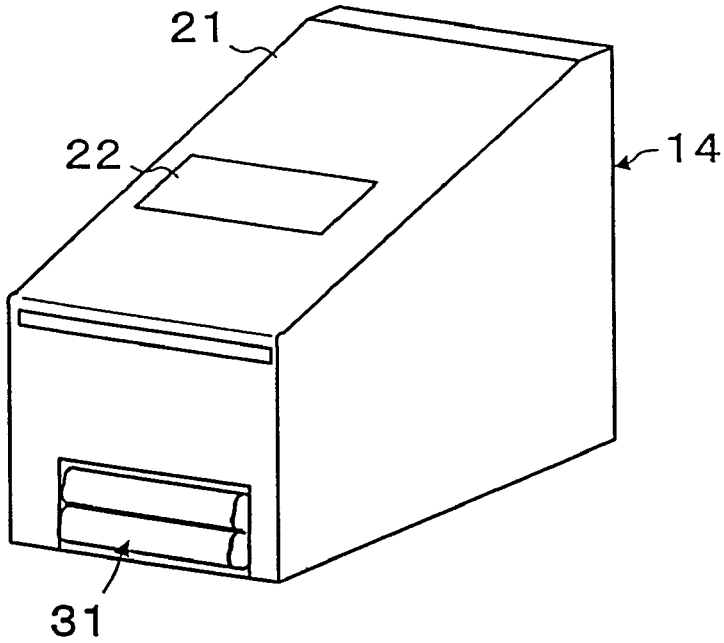
FIG. 2 shows the removable safe unit.

In reference to FIG. 1, the present invention provides a novel banknote dispensing device 1 utilizing a one-way clutch 36 for transferring a banknote from a banknote supply storing section 24 at one speed to a banknote transporting unit 5 at a second, higher speed while avoiding damage to the banknote due to the difference in speed in the transfer.

In this specification, a banknote may be paper currency, a certificate, a bill, a note, or any similar thin, flexible article of a substantially rectangular shape that may be stored, manipulated, and dispensed as herein described.

The banknote dispensing device includes a banknote supply storing section 24 for storing banknotes, a banknote discharging unit 4 for discharging the banknotes at a first speed, a banknote transporting unit 5 for transporting the discharged banknote at a second, higher speed, a package dispensing unit 6 to outputting the discharged banknotes, and a control unit 7 for receiving signals from and controlling the actions of the dispensing device.

The banknote discharge unit 4 includes a first motor 81 (not shown) driving a driving shaft 35. The driving shaft in turn drives a one-way clutch 36 that drives a feed roller 34. The control unit 7 enables the first motor 81 to drive the feed roller 34 in order to discharge banknotes from the banknote supply storing section 24.

The feed roller 34 has a peripheral edge adjacent to the banknote supply storing section 24 that contacts one of the stored banknotes 25 in the banknote supply storing section. The feed roller 34 discharges a stored banknote 25 to the banknote transporting unit 5 at a first predetermined speed that depends on the rotation speed of the feed roller 34 driven by the one-way clutch 36 which is driven by a driving shaft 35. Feed roller 34 can be changed to a roller with one or more radial projections. In one embodiment of the feed roller with one or more radial projections, the feed roller 34 can stop at a position where the radial projection does not have contact with the banknote 25.

The discharged banknote is pulled into the transporting unit 5 at a second speed, which is faster than the first speed. When the banknote is pulled at the second, faster speed, feed roller 34 is still in contact with the banknote and the one-way clutch 36 driving the feed roller 34 automatically allows the banknote to be continuously pulled at the faster speed while avoiding excessive strain on the banknote at this transition.

The transporting unit 5 includes a first transporting unit 38 for receiving the discharged banknote and moving the banknote through an initial portion of the transporting unit 5, a second transporting unit 41 for receiving the discharged banknote from the first transporting unit 38 and moving the banknote through an intermediate portion of the transporting unit, a diverting unit 42 for diverting a defective banknote to a rejected banknote storing section 17, a third transporting unit 43 for receiving the discharged banknote from the second transporting unit 41 and moving the banknote through a final portion of the transporting unit, and four sensors (75, 76, 78, 79) that are used to determine if the banknote has been transported successfully through the transporting unit 5. A fifth sensor 80 is used to determine when banknotes have been dispensed and subsequently removed by a user.

The path from the first transporting unit 38 through the second transporting unit 41 to the third transporting unit 43 is considered a first path, and is the normal path a discharged banknote will take if the banknote is not defective and the banknote transporting unit 5 does not jam or otherwise fail to properly transport the discharged banknote. This first path may also be called the normal banknote discharge path since the banknote will be normally be discharged to the temporary discharge section 60.

The path from the first transporting unit 38 through the second transporting unit 41 and to the diverting unit 42 and the rejected banknote storing section is considered a second path, and is the path a discharged banknote will take if the banknote is determined to be unacceptable for dispensing. This second path may also be called the rejected banknote storing path since the rejected banknote will be stored in the rejected banknote storing section 17.

The five sensors (75, 76, 78, 79, 80) may be of various designs such as a transmitting photoelectric sensor, a reflecting photoelectric sensor, or mechanical sensor to detect the presence of a banknote between the emitter/receiver pair in order to determine the presence and length of the banknote given the known transport speeds of the moving elements.

More sophisticated sensors may be employed to detect properties other than the length of the banknote. These properties may indicate the particular denomination, composition of the banknote, or some other distinguishing feature that the control unit 7 may use in order to determine whether the banknote is acceptable for dispensing.

The five sensors (75, 76, 78, 79, 80) each output a signal. The term signal may reflect either a particular electrical property such as a voltage or impedance level, or it may reflect a time-sequence of a particular electrical property such as a voltage or impedance waveform.

The first sensor 75 detects a banknote as it is received by the first transporting unit 38 of the banknote transporting unit 5. The second sensor 76 detects a discharged banknote in the U-shaped transport passageway 40. The third sensor 78 detects a diverted banknote as it is entering the rejected banknote storing section 17. The fourth sensor 79 detects the presence of the banknote as it is emitted from the transporting unit 5 at the normal discharge point into the temporary storing section 60.

The fifth sensor detects the accumulated banknotes as they are protruding out of the dispensing slot 63. The control unit 7 receives signals from the sensors and compares the received signals to determine whether the banknote was discharged, transported, and dispensed properly. The control unit 7 has an alarm emitter (not shown) to emit an audible to indicate an error or problem condition.

The diverting unit 42 is used to route a selected banknote to a rejected banknote storing section 17 by interposing a deflecting element called a diverting board 59 into the path of the banknote after it is received by the banknote transporting unit 5. The deflecting element is normally interposed to deflect a transported banknote and is moved to a non-interposing position if the transported banknote is determined to be acceptable for dispensing. A banknote may be rejected if it is detected to be defective or inappropriate by the control unit 7 after interpreting the signals from the length sensor 77.

The length sensor 77 is composed of the first sensor 75 and the second sensor 76 which are used together to determine the length of the transported banknote. In many applications, banknotes of different sizes indicate different denominations. A larger denomination is commonly a physically larger banknote both in length and width. Hence, by precisely detecting the actual length and comparing to an expected length, the denomination may be accurately determined.

Most commonly, a banknote would be found to be unacceptable if the signals from the length sensor 77 indicate the banknote is the wrong size, either too long or too short. Such a banknote would not be dispensed, and would instead be stored in the rejected banknote storing section 17. A damaged or torn banknote may also be detected in this manner.

Once the predetermined number of banknotes, for example four banknotes, are accumulated in the temporary storing section 60, the dispensing pusher unit 61 is used to dispense the accumulated discharged banknotes to the user. The package dispensing unit 6 is activated by the control unit 7. The package dispensing unit 6 receives a predetermined number of discharged banknotes from the third transporting unit 43 prior to dispensing the assembled banknotes to a user.

The predetermined number of discharged banknotes may be any permissible number determined by the control unit 7. For example, the predetermined number of discharged banknotes can be four in order to accommodate change from a five dollar bill, or can be nine in order to accommodate change from a ten dollar bill. The local banknotes used, the parameters of the control unit operation, and the predetermined number of discharged banknotes may vary.

The package dispensing unit 6 includes the temporary storing section 60 and the dispensing pusher unit 61. The temporary storing section includes tray 58 and the banknote retainer 90. Tray 58 is located adjacent the eighth pressing roller 57 and the tray bottom 62 is slightly longer than the largest acceptable stored note 25. Banknote retainer 90 can be a blade spring fixed at a short distance to fourth roller 55 and the other end is located near to and parallel with the tray bottom 62. Banknote 25 is fed to tray 58 by the third transporting unit 43 and is held by the banknote retainer 90.

The dispensing pusher unit 61 includes slider unit 71, guiding rail 68, and belt transporting unit 83. Slider unit 71 includes pushing block 69 and driven plate 72. Pushing block 69 and driven plate 72 extend in a perpendicular manner from slider 71. Driven plate 72 has two segments, the first segment being perpendicular to the slider unit 71, the second segment being connected to the first segment, but extending at an angle inclined in the direction of the dispensing slot 63. At the end of the driven plate 72, at a point farthest from the slider unit 71, is the first driven pin 73. At the junction of the two segments of the driven plate 72 is the second driven pin 74.

The belt transporting unit 83 includes timing belt 66, first timing pulley 64, second timing pulley 65, a projection 67 that is perpendicular to the exterior surface of the timing belt 66, and a third motor 82 (not shown). In reference to FIG. 1, with the slider unit 71 in a first position on the far left side of the guiding rail 68, the third motor 82 starts and drives the timing belt 66 to rotate in a counter clock-wise fashion. As the timing belt 66 rotates, the projection 67 makes contact with the second driven pin 74 to push the slider unit 71 along the guiding rail 68 in a direction from left to right as shown in FIG. 1.

The slider unit 71 moves from left to right along guiding rail 68 to cause the pushing block 69 to contact the accumulated banknotes in the temporary storing tray 58 and push the accumulated banknotes to the right, past banknote sensor 80 in order that a portion of the assembled banknote package will protrude from the dispensing slot 63 in order to be grasped by the hand of a user.

After the slider unit 71 reaches the second position, at the far right side of the guiding rail 68, the timing belt 66 continues to move in a counter clock-wise fashion. The projection 67 breaks contact with the second driven pin 74 and follows the curvature of the second timing pulley 65 until the projection 67 makes contact with the first driven pin 73 on the driven plate 72.

As the timing belt continues to move in a counter clockwise fashion, the projection 67 pushes the first driven pin 73 and the driven plate 72 back to the left, breaking contact with the recently pushed banknotes, and returning the slider unit 71 to a position in preparation to push subsequent accumulated banknotes to the dispensing slot. Once the slider unit 71 reaches the terminal point at the left side of the guiding rail 68, the projection 67 breaks contact with the first driven pin 73 and follows the curvature of the first timing pulley 64. The third motor 82 then stops.

Figure 4:
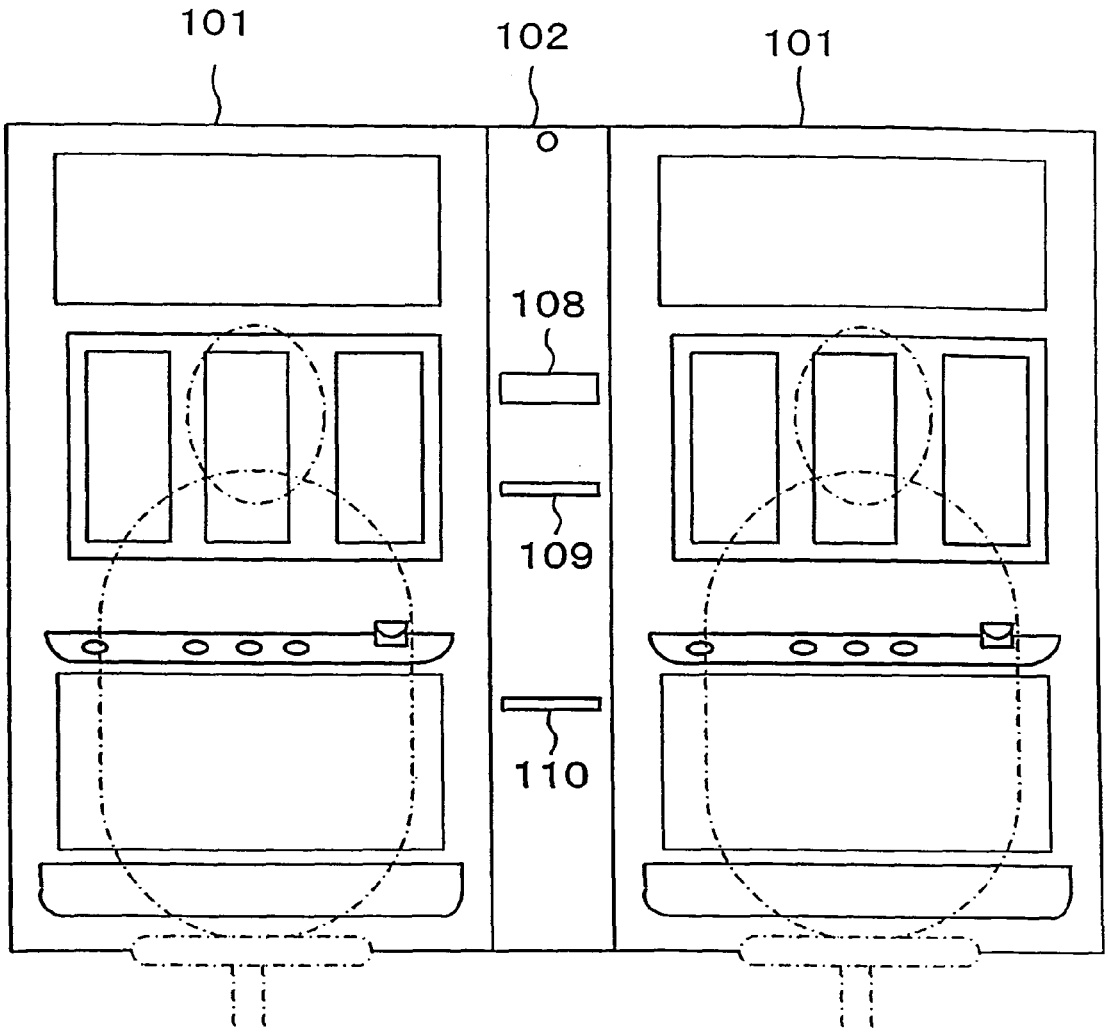
Fig. 4 (Prior Art)
FIG. 4 shows the placement of a purchasing station disposed between two gaming machines.
Figure 5:
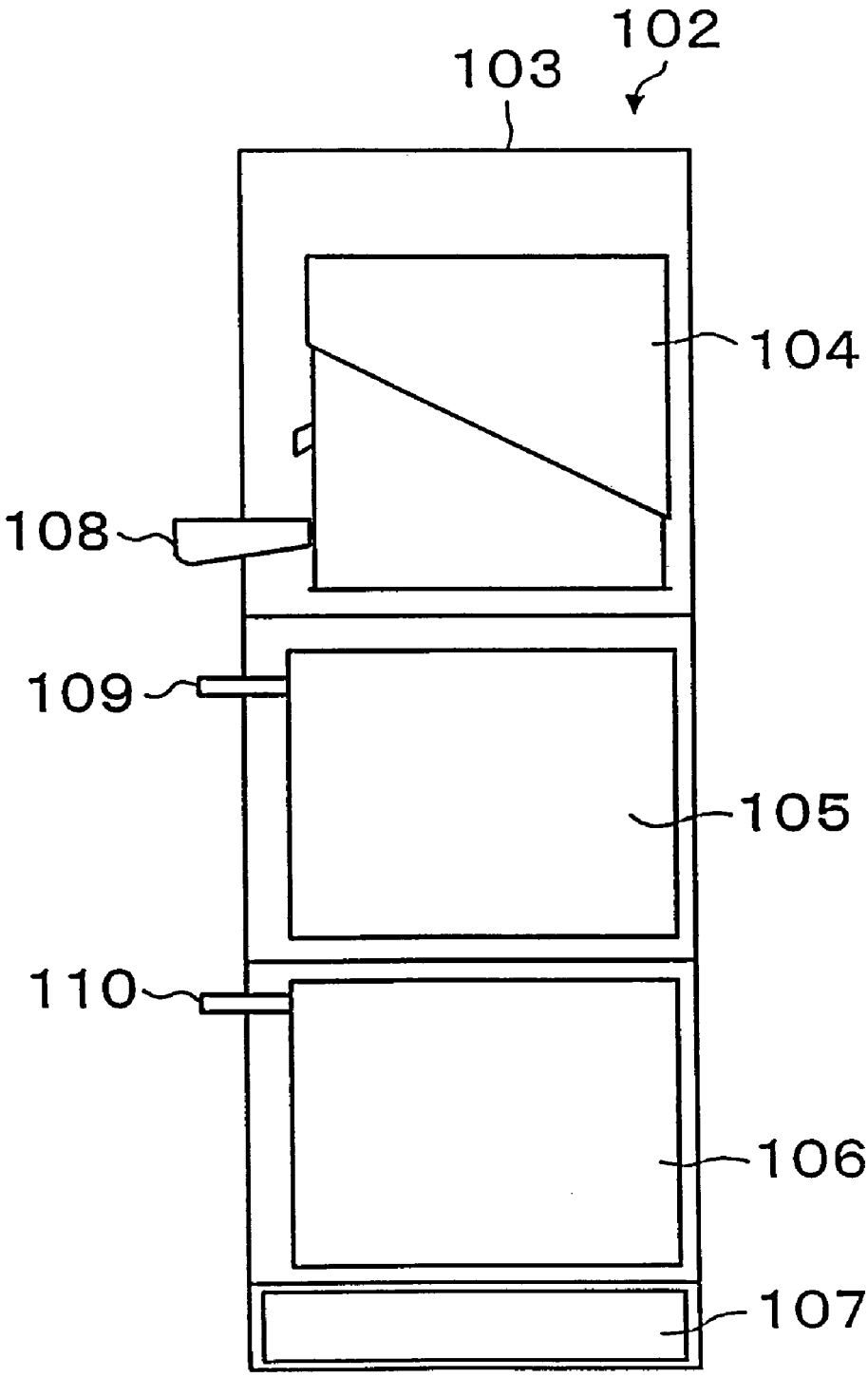
Fig. 5 (Prior Art)
FIG. 5 shows a profile view of the side of a purchasing station showing a token dispensing unit a banknote accepting device and the banknote dispensing device of the present invention.

The dispensing slot 63 is aligned with the external slot 110 as shown in FIG. 4. While the accumulated banknotes are dispensed and waiting for a user to take them, the sensor 80 will indicate their position as dispensed and waiting. Once the accumulated banknotes are taken by a user, the sensor 80 will indicate the banknotes are no longer protruding from the dispensing device 1. If the dispensed banknotes are not picked up by the user in a predetermined amount of time, the controller will cause an audible alarm to sound indicating this condition.

In reference to FIG. 1, the banknote dispensing unit 1 includes a box-like chassis 2. The box-like chassis 2 has a cavity that is adapted to receive a banknote safe 14 into a banknote safe attaching section 3. Opening 10 of the safe attaching section 3 can be a closed lid 9 which can pivot at chassis 2. Safe attaching section 3 includes a long edge which extends up and down at opening 10, a short edge 11 which faces the long edge 10 is parallel, lower edge 12 which is located between the long edge and the short edge is horizontal and slanting edge 13 which faces the lower edge 12. The banknote safe attaching section 3 has a substantially trapezoidal shape to accommodate the banknote safe 14 which includes the banknote supply storing section 24 for retaining stored banknotes 25 at an angle inclined to horizontal. The banknote safe 14 comprises a removable storage unit that is ruggedly constructed for increased durability and to resist tampering.

The stored banknotes 25 are held at an inclined angle in the banknote supply storing section 24 to accommodate larger banknotes in a shorter longitudinal length of the banknote dispensing device 1, and to facilitate the discharge of banknotes by the assistance of gravity as the banknotes are discharged in a slightly downward direction. The shorter longitudinal length allows the dispensing device 1 to occupy a more compact space while dispensing larger banknotes.

Inside of banknote safe 8 is a banknote supply storing section 24 for retaining stored banknotes 25 prior to dispensing and a rejected banknote storing section 17 for retaining banknotes that have been rejected during dispensing. The banknote supply storing section 24 is separated from the rejected banknote storing section 17 by the separating plate 15.

Pushing plate 19 is arranged underneath the stored banknotes 25 and is biased by a spring 23 to apply pressure to the stored banknotes 25 in order to maintain the stored banknotes 25 in a position against the feed roller 34 which extends through the opening 22.

When a stored banknote 25 is discharged from the banknote supply storing section 24 by the feed roller 34, the discharged banknote slides in a slightly downward direction and through an exit point 84 (not shown) where the separating unit 27 ensures discharged banknotes are separated one-by-one to prevent the discharge of more than one banknote at a time.

Separating unit 27 includes fixed wall 28 which is straight and connects slanting wall 21 and moving roller 29 which is a rotatable cylinder and can be away from the fixed wall 28 a predetermined distance.

Banknotes are discharged from the banknote supply storing section 24 at a first speed determined by the rotation speed of the feed roller 34. Once the discharged banknote passes separating unit 27, the discharged banknote passes the first sensor 75 and is received by first transporting unit 38 in the banknote transporting unit 5.

The first sensor 75 outputs a first signal to the control unit 7 indicating the beginning, end, and duration of time the banknote is detected by the first sensor 75 based on the transport speed of the banknote in the first transporting unit 38. The beginning, end, and duration describe a time-based waveform having a rising edge, a falling edge, and a detected value.

After the discharged banknote passes through the U-shaped banknote passageway 40, the discharged banknote passes the second sensor 76. The second sensor outputs a second signal to the control unit 7 indicating the beginning, end, and duration of time the banknote is detected by the second sensor 76 based on the transport speed of the banknote in the first transporting unit 38. The first sensor 75 and the second sensor 76 together comprise the length sensor 77.

The length sensor 77 is used to determine the length of a discharged banknote in order to determine if the banknote is acceptable for dispensing. If the discharged banknote is acceptable for dispensing, the diverting unit 42 is activated by the control unit 7 by energizing the diverting solenoid 85 (not shown). In reference to FIG. 1, the diverting solenoid 85 rotates the fixed shaft 58 to rotate the diverting board 59 in a clockwise fashion in order to bring the diverting board 59 to a position to allow the discharged banknote to pass from the second transporting unit 41 to the third transporting unit 43.

Conversely, if the banknote is not acceptable for dispensing, the control unit 7 will not energize the diverting solenoid 85, and the discharged banknote will be diverted by the diverting board 59 to a second path leading to the rejected banknote storing section 17.

Given the known parameters of the transport speed of the discharge unit 4, the discharge speed of the first transporting unit 38, and the expected length of the banknote, the control unit 7 can determine if the banknote is defective and should be retained in the rejected banknote storing section 17 rather than dispensed from the banknote dispensing unit 1.

The first transporting unit 38 includes a second motor 50 for driving a first roller 44 and a guiding unit 39 for driving a discharged banknote through the initial portion of the banknote transporting unit 5. The first roller 44 has a companion first pressing roller 45 arranged adjacent to the first roller to form a passage for the discharged banknote between the adjacent rollers.

Figure 3:
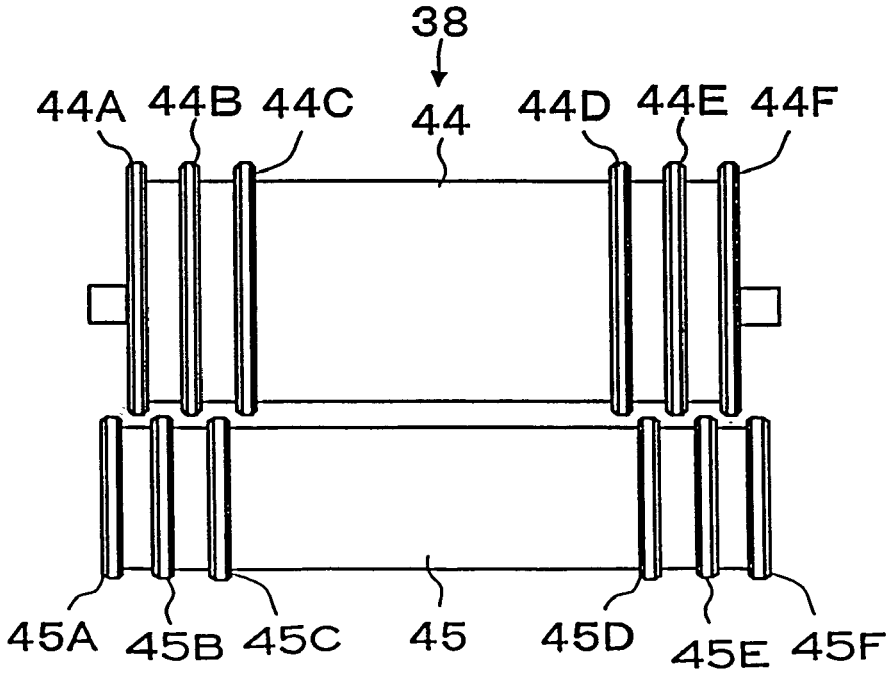
FIG. 3 shows the interposed radial extensions of the first roller and the first pressing roller showing how the radial extensions alternate in a direction along the axis of rotation.

In reference to FIG. 3, the first roller 44 and the first pressing roller 45 having two or more rotating projections (44A-44F and 45A-45F) radially protruding from the surface of the first roller 44 and the first pressing roller 45. The radial, rotating projections are arranged in an staggered, alternating, or offset manner to allow the first roller and the first pressing roller to retain and conduct a discharged banknote in a wave-like manner. The description wave-like refers to the alternating up and down deflections perpendicular to the direction of travel between the opposing first roller 44 and first pressing roller 45. The spaces between the radial, rotating projections can be considered projection free portions.

In reference to FIG. 1, the first roller 44 has a companion second pressing roller 46 arranged adjacent to the first roller to form a passage for the discharged banknote between the adjacent rollers after the discharged banknote has passed through the passage created by the first roller 44 and the first pressing roller 46.

The guiding unit 39 is arranged adjacent to the second motor 50 and above the first transporting unit 38. The guiding unit 39 includes guiding roller 47, third pressing roller 48, and fourth pressing roller 49 arranged so that the third pressing roller 48 and the fourth pressing roller 49 have contact with the periphery of the guiding roller 47 and form a passageway for the discharged banknote between the guiding roller 47 and the companion pressing rollers (48, 49). Around the guiding roller 47 is a U-shaped banknote passageway 40 where the banknote travels around more than half of the guiding roller 47. The folded over configuration of the U-shaped passageway enables the dispensing device 1 to be implemented in a compact space.

Similarly, the guiding unit 39 has companion pressure rollers to form a passageway for the discharged banknote. The discharged banknote is driven by the first roller 44 at a substantially higher speed than the feed roller 34. The guiding unit 39 extends the travel path of the discharged banknote in a non-planar manner, directing the travel path upwards in FIG. 1, to allow the banknote to be accurately measured by the length sensor 77 while reducing the longitudinal length of the dispensing device. This allows the dispensing device to be more compact than prior dispensing devices.

To prevent damage to the discharged banknote, the feed roller 34 is driven by a one-way clutch attached to the driving shaft 35 so that even though the discharged banknote is driven at a first speed by the feed roller 34, the discharged banknote may be continuously pulled at a second, higher speed by the first roller 44. The one-way clutch 36 allows the banknote to be continuously pulled at the higher speed, and does not limit the length of the banknote that may be pulled at a higher speed.

Figure 6:
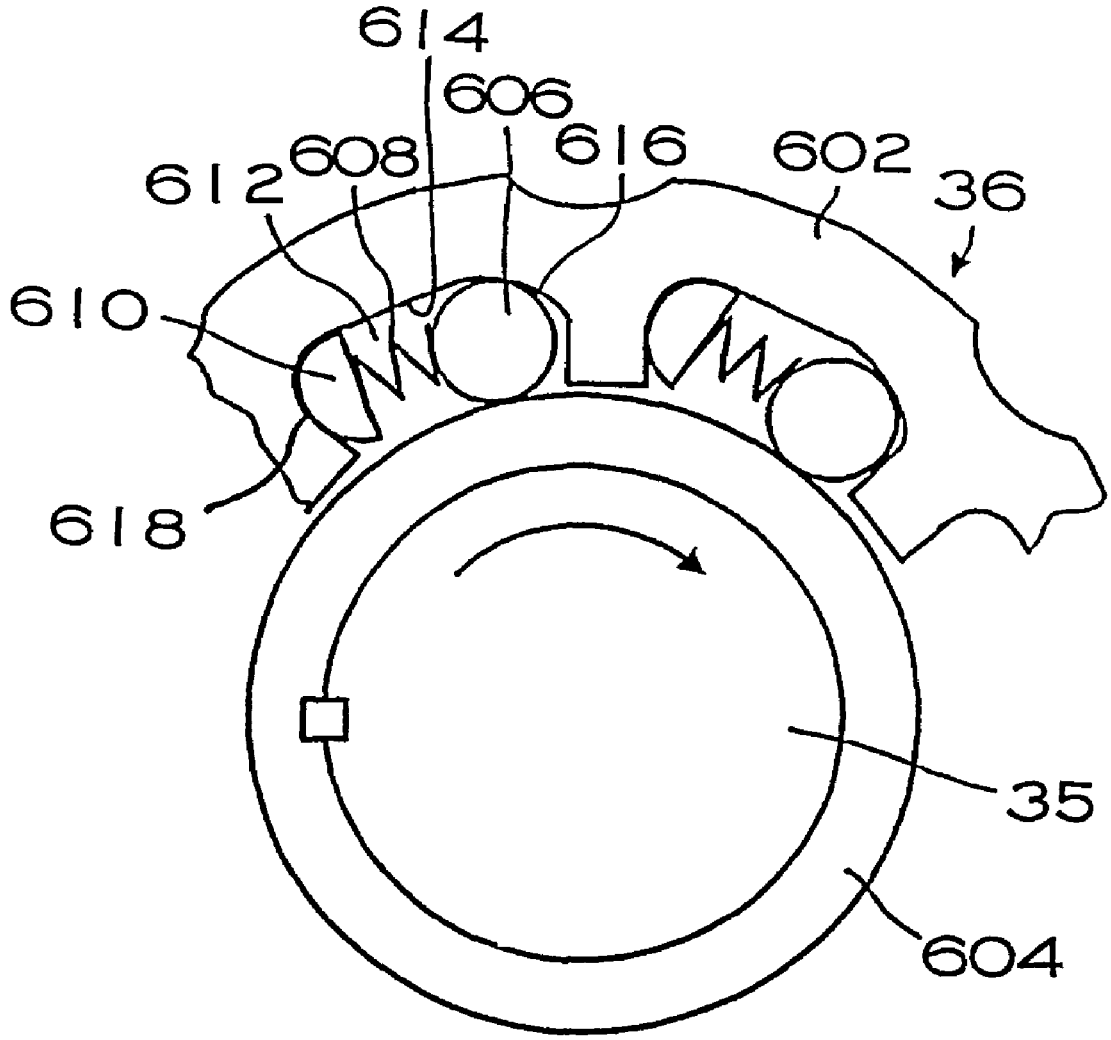
FIG. 6 shows an embodiment of the one-way clutch where the driving shaft is driving the peripheral edge of the feed roller.

In reference to FIG. 6, feed roller 34 is a friction roller which is cylindrical in shape and is fixed at the outer surface of the outer race 602 of the one-way clutch 36. Alternatively, the feed rollers and companion rollers may be cylindrical segments arranged oppositely, to reduce cost while maintaining positive contact with the banknote. In one embodiment, the feed roller 34 comprises a material with a high coefficient of friction as well as durability and high wear resistance. Ethylene Propylene Diene Monomer (EPDM) is an example of a suitable material for the feed roller 34.

The one-way clutch 36 includes an outer race 602 and an inner race 604 where the inner race 604 is fixed to a driving shaft 35. On the interior region of the outer race 602 are a number of holding grooves 612. Each holding groove 612 comprises a locking wall 616, a releasing wall 614, and a retainer wall 618.

Each holding groove 612 is U-shaped and contains a retainer 610, a spring 608, and a ball 606 that are arranged so that the retainer 610 is adjacent to the retainer wall 618, the ball 606 is adjacent to the locking wall 616, and the spring 608 is interposed between the retainer 610 and the ball 606 in order to bias the ball 606 against the locking wall 616.

As shown in FIG. 6, the locking wall 616 is a narrowing of the holding groove 612 in a dimension radial to the driving shaft 35 so that when the ball 606 is placed against the holding groove 612, the inner race 604 is driving the outer race 602 in a clockwise direction. This describes how the driving shaft 35 is driving the outer race 602 in the direction of rotation.

Figure 7:
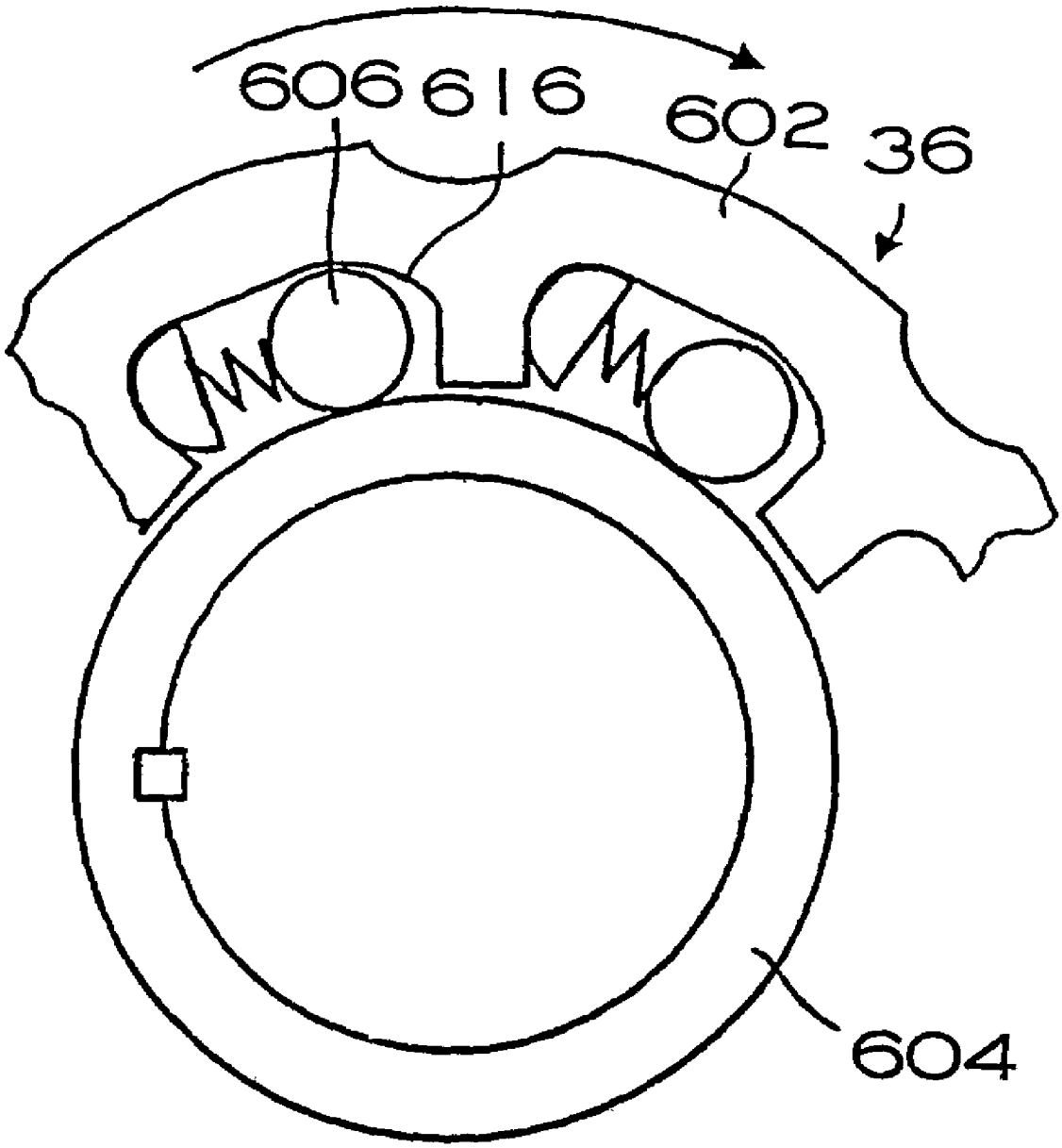
FIG. 7 shows an embodiment of the one-way clutch where the peripheral edge of the feed roller is allowed to advance faster than the rotation speed of the driving shaft.

As shown in FIG. 7, when the outer race 602 is driven faster than the driving shaft 35, such as when the first roller 44 is pulling a banknote, the ball 606 is forced in the direction of the retainer 610 compressing the spring 608 and allowing the outer race 602 to slide over the inner race 604 to permit the outer race 602 to rotate faster in the direction of rotation than the inner race 604. This describes how the outer race 602 may be pulled faster than the rotation speed of the driving shaft 35 to prevent damage to a banknote.

Referring again to FIG. 1, the second transporting unit 41 includes a second roller 51, a diverting unit 42, a third sensor 78, and a drawing unit 31. The second transporting unit 41 receives the discharged banknote from the first transporting unit 38 and passes the discharged banknote through an intermediate portion of the banknote transporting unit 5.

If a banknote is detected as being defective or otherwise inappropriate for dispensing, it is rejected before being dispensed from the dispensing device 1. A rejected banknote is deflected by the diverting unit 42 and stored in the rejected banknote storing section 17 which is located below the separating plate 15.

The diverted banknote passes through the second transporting unit 41, around the second roller 51, is deflected by the diverting unit 42 and then pulled between rollers in the drawing unit 31 to enter the rejected banknote storing section 17. The rejected banknotes are thereby stored in a lower portion of the safe 14 to permit later examination and possible removal from circulation. The third sensor 78 detects the presence of the discharged banknote on the way to the rejected banknote storing section 17.

If the discharged banknote is not determined to be defective, the diverting unit 42 is activated to allow the discharged banknote to pass to the third transporting unit 43 which receives the discharged banknote from the second transporting unit 41 and passes the discharged banknote through the final portion of the banknote transporting unit 5.

The third transporting unit 43 includes a third roller 55, a fourth sensor 79, companion seventh pressing roller 56, and companion eighth pressing roller 57. The seventh pressing roller 56 and eighth pressing roller 57 are adjacent to the third roller and form a passageway for the discharged banknote between the companion rollers (56, 57) and the third roller 55. As discussed supra, if the discharged banknote is determined to be defective, the diverting unit 42 is not activated, and remains in a diverting position to conduct the discharged banknote to the rejected banknote storing section 17.

The second roller 51 and the third roller 55 are driven by a belt transmitting unit 54 that is driven by a friction roller 86 placed against the first roller 44. The belt transmitting unit 54 provides synchronization of the first roller 44, the second roller 51, and the third roller 55 to ensures the rollers are driven at the same speed. As shown in FIG. 1, the first roller normally rotates in a clockwise direction.

The friction roller 86 normally rotates in the opposite direction, in a counter clockwise direction. The friction roller 86 drives the second roller 51 and the third roller 55 in a counter clockwise direction. The synchronization and driving method is not limited to only a belt as other means such as gears may also be used.

Figure 8:
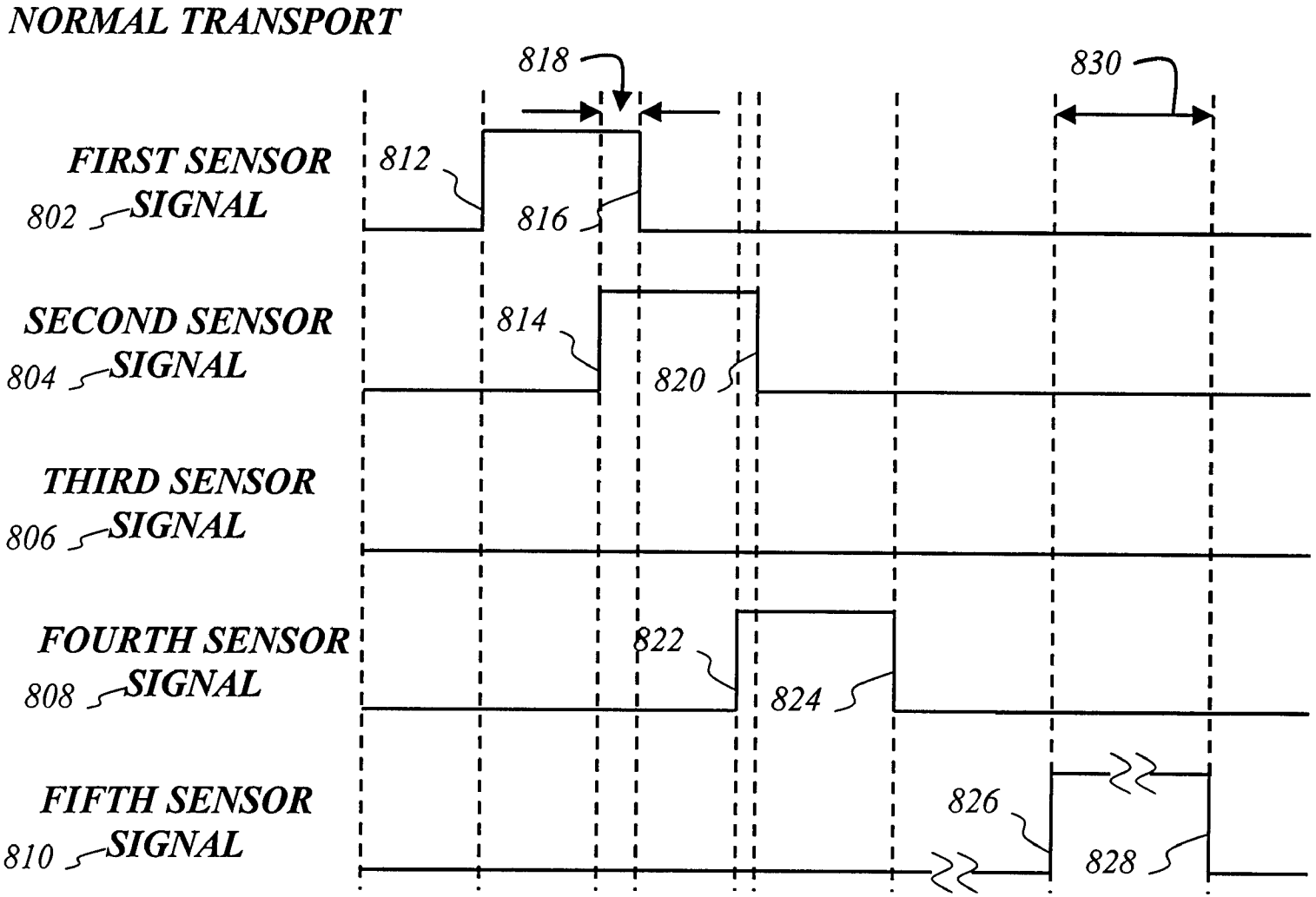
FIG. 8 shows the normal transfer of a banknote from the banknote supply storing device through the banknote transport device to the temporary banknote storing section and then the dispensed banknotes being taken by a user.

FIG. 8 shows receiving a banknote into the first transporting unit 38 and discharging the banknote from the third transporting unit 43 into the temporary storing section 60, also called a normal transport. The pattern of signals in FIG. 8 indicates the banknote transporting unit 5 has successfully transported the discharged banknote from the banknote supply storing section 24 to the temporary storing section 60.

The first sensor 75 asserts the first sensor signal 802. The rising edge 812 of the first sensor signal 802 indicates the leading edge of the discharged banknote is detected by the first sensor 75 and is considered a detecting condition. The first sensor signal 802 remains at a high value while the banknote is present next to the first sensor 75 during receipt into the banknote transporting unit 5.

The second sensor 76 asserts the second sensor signal 804. The rising edge 814 of the second sensor signal 804 indicates the leading edge of the discharged banknote is detected by the second sensor 76 and is considered a detecting condition. The second sensor signal 804 remains at a high value while the banknote is present next to the second sensor 76 during receipt into the banknote transporting unit 5.

At a predetermined time, the falling edge 816 of the first sensor signal is received by the controller 7 indicating the trailing edge of the discharged banknote is detected. This is considered a non-detecting condition. The length overlap 818 indicates the length of the discharged banknote since the transport speed of the transporting unit and the distance between the first sensor 75 and the second sensor 76 are known. The controller 7 compares the length overlap 818 with a range of acceptable values to determine whether the discharged banknote is acceptable for dispensing.

If the length overlap 818 is acceptable, the diverting solenoid 85 is activated to allow the acceptable banknote to pass through the second transporting unit 41 to the third transporting unit 43 and into the temporary storing section 60. As the discharged banknote passes through the third transporting unit 43, the fourth sensor 79 detects the leading edge 822 and the trailing edge 824 of the transported banknote indicating the banknote was successfully passed to the temporary storing section 60. Once a predetermined number of discharged banknotes have been successfully transported to the temporary storing section 60, the package dispensing unit 6 is activated to push the accumulated banknotes in the temporary storing section out to the dispensing slot 63.

When the accumulated discharged banknotes are pushed to the dispensing slot 63, they are detected by the fifth sensor 80 also called the dispensed banknote sensor 80. The rising edge 826 of the fifth sensor signal 810 indicates the accumulated banknotes are newly detected in the dispensing slot 63.

The dispensed banknotes will remain in the dispensing slot 63 until grasped and removed by a user. The dispensing time 830 indicates how long the dispensed banknotes are waiting in the dispensing slot 63. Once the accumulated banknotes are grasped and removed from the dispensing device 1, the falling edge 828 will indicate the banknotes are no longer in the dispensing slot 63.

If the accumulated banknotes are not removed in a predetermined amount of time, the control unit 7 causes an alarm to sound indicating to the user is requested to remove the dispensed banknotes that are protruding from the dispensing slot. Similarly, if the control unit 7 receives another request to discharge banknotes before the previous package of accumulated banknotes has been removed from the dispensing slot, the alarm will sound indicating this error condition.

Figure 9:
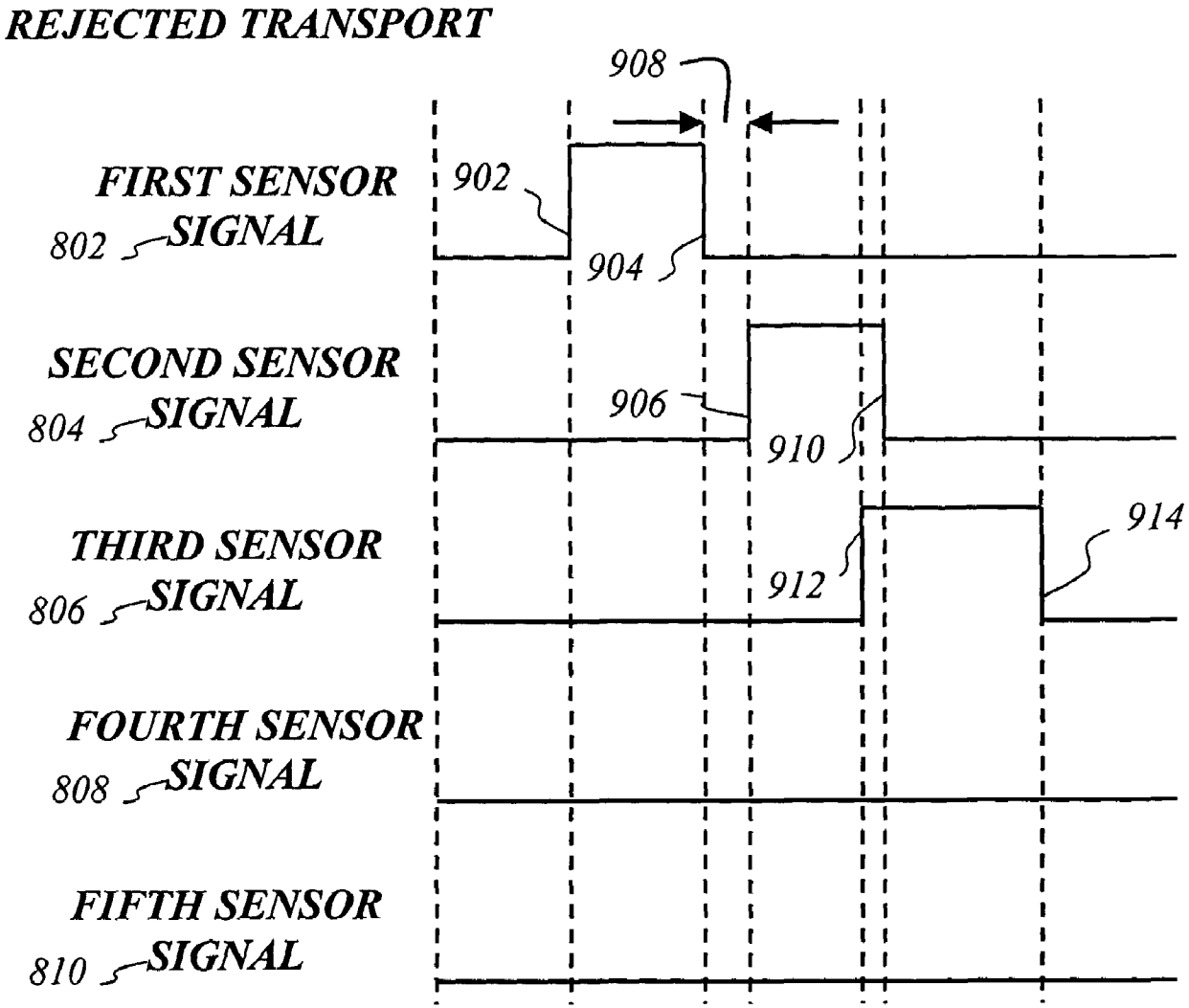
FIG. 9 shows the rejected transfer of a banknote from the banknote supply storing device through the banknote transport device to the rejected banknote storing section.

FIG. 9 shows receiving a banknote into the first transporting unit 38 and discharging the banknote from the second transporting unit 41 into the rejected banknote storing section 17, also called a rejected transport. The pattern of signals in FIG. 9 indicates the banknote transporting unit 5 has successfully transported the discharged banknote from the banknote supply storing section 24 to the rejected banknote storing section 17.

The first sensor 75 asserts the first sensor signal 802. The rising edge 902 of the first sensor signal 802 indicates the leading edge of the discharged banknote is detected by the first sensor 75 and is considered a detecting condition. The first sensor signal 802 remains at a high value while the banknote is present next to the first sensor 75 during receipt into the banknote transporting unit 5. The falling edge 904 of the first sensor signal indicates the trailing edge of the discharged banknote was detected.

The rising edge 906 of the second sensor signal 804 indicates the leading edge of the discharged banknote has reached the second sensor 76. Since the first sensor 75 and the second sensor 76 are spaced a distance apart that is less than the expected length of the discharged banknote, an overlapping time where both the first sensor signal 802 and the second sensor signal 804 simultaneously remain high in a detecting condition is expected.

If that overlap 818 is less than expected, or is a gap 908 where no overlap occurs, then the control unit 7 determines the discharged banknote is not acceptable for dispensing, the diverting solenoid 85 is not activated, which allows the unacceptable banknote to be routed through the second transporting unit 41 to the rejected banknote storing section 17.

The third sensor 78 asserts the third sensor signal 806. The rising edge 912 of the third sensor signal 806 indicates the leading edge of the discharged banknote is detected by the third sensor 78 and is considered a detecting condition. The third sensor signal 806 remains at a high value while the banknote is present next to the third sensor 78 during transport to the rejected banknote storing section 17.

The falling edge 914 of the third sensor signal 806 indicates the discharged banknote has been successfully transported to the rejected banknote storing section 17. In all cases, the control unit 7 expects the rising and falling edges to be spaced a predetermined distance apart in time. If a particular sensor indicates a value outside acceptable parameters, a problem such as a jamming condition is detected.

Figure 10:
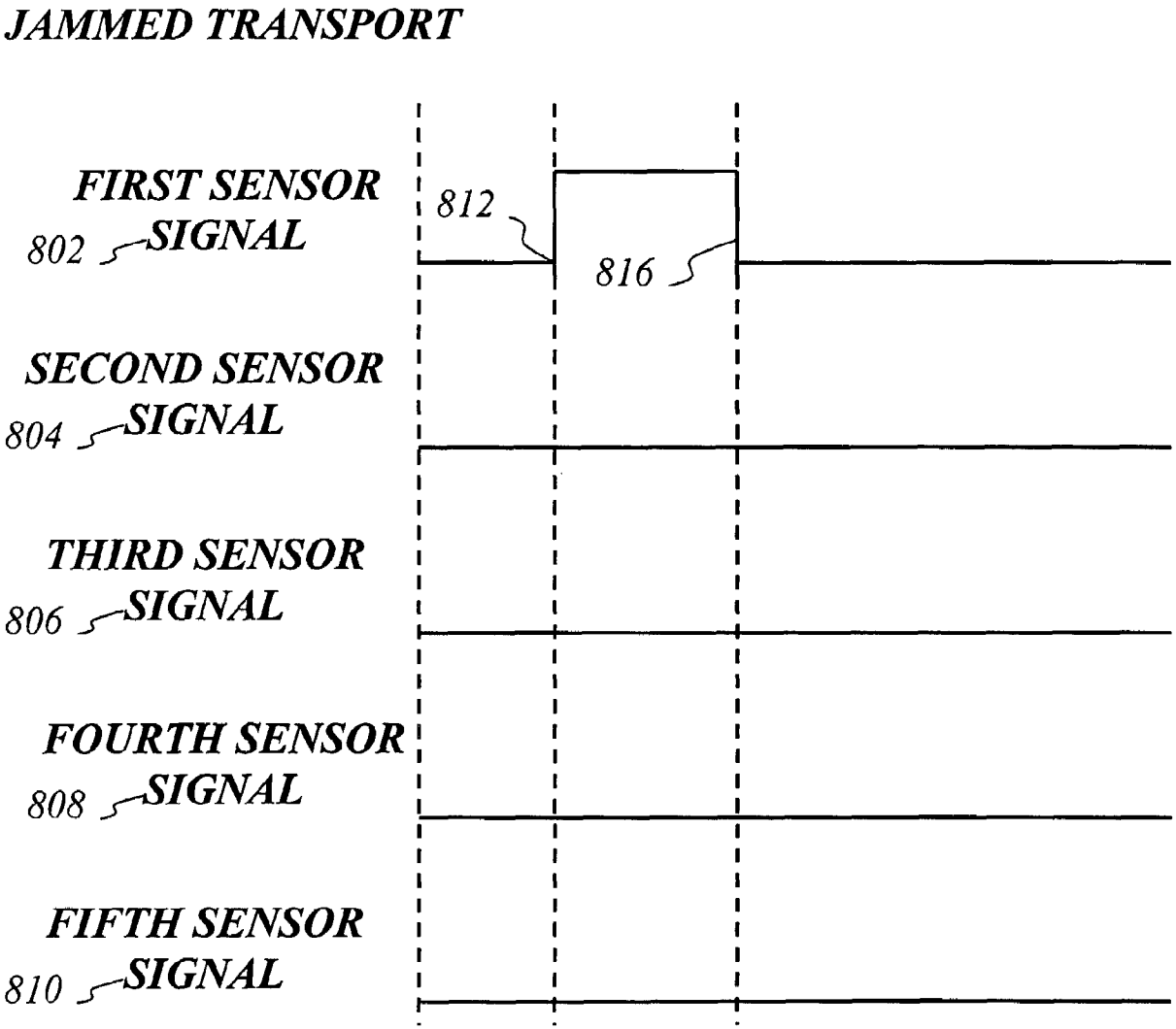
FIG. 10 shows a jamming transfer of a banknote from the banknote supply storing device through the transport device where the discharged banknote becomes jammed prior to the second transporting unit and does not successfully pass through the banknote transport unit. Banknote transfer jamming may occur at other locations within the dispensing device.

In reference to FIG. 10, a discharged banknote has been detected by the first sensor 75, but the banknote was not successfully detected by subsequent sensors. This indicates an error condition like a jamming of the banknote in the banknote transporting unit 5 or the failure of one or more sensors. The control unit 7 detects this condition and stops motors 81 and 50.

The control unit 7 receives and processes signals from the sensors and determines the proper control of the first motor 81 (not shown), the second motor 50, the activation of the diverting unit, and the movement of the package dispensing unit 6. The control unit 7 may include a microprocessor with appropriate interface circuits under the control of a microprogram, or can include discrete electronic components used to perform the controlling functions.

Those skilled in the art will appreciate that various adaptations and modifications of the just-described preferred embodiment can be configured without departing from the scope and spirit of the invention. Therefore, it is to be understood that, within the scope of the amended claims, the invention may be practiced other than as specifically described herein.

What is claimed is:

1. A compact banknote dispensing device, comprising:

a banknote supply storing section for storing one or more banknotes;

a banknote transporting unit for transporting a stored banknote, the banknote transporting unit being adjacent to the banknote supply storing section for receiving a stored banknote from the banknote supply storing section, wherein the banknote transporting unit includes a U-shaped transporting path including a first roller, a guiding roller and a second transporting roller, the first roller being adjacent to the banknote supply storing section, the guiding roller being adjacent the first roller to receive the banknote on a side opposite to the side of the first roller, the second roller being disposed on the side of the first roller on a side opposite to the guiding roller to enable the transported banknote to traverse a U-shaped path around the first roller, the guiding roller, and the second roller;

a banknote length sensor unit located within the banknote transporting unit adjacent to the U-shaped transporting path for detecting a length of transported banknotes; and a dispensing slot for dispensing the transported banknotes, wherein the banknote length sensor unit is adjacent to the U-shaped transporting path, the banknote length sensor comprising a first banknote sensor and a second banknote sensor, the first banknote sensor being adjacent to the first roller to detect the banknote as it is received by the first roller, the second banknote sensor being disposed between the guiding roller and the second roller so that the first sensor and the second sensor are spaced at a distance along the U-shaped transporting path that is less than the length of the shortest valid banknotes, wherein the banknote supply storing section is inclined at an angle to permit the stored banknotes to be stored in a more compact longitudinal distance and to facilitate discharging of banknotes in a downward direction.

2. The compact banknote dispensing device of claim 1, further comprising:

a first sensor for detecting the presence of a banknote received by the banknote transporting unit, the first sensor outputting a first signal to indicate the presence of the banknote adjacent to the first sensor;

a second sensor for detecting the presence of a banknote discharged by the banknote transporting unit, the second sensor outputting a second signal to indicate the presence of the banknote adjacent to the second sensor; and a control unit for receiving and processing the first signal and the second signal, the control unit comparing the first signal with the second signal to determine whether a banknote has successfully passed through the banknote transporting unit.

3. The compact banknote dispensing device of claim 2, further comprising:

a temporary storing section for receiving a predetermined number of discharged banknotes, the temporary storing section being arranged adjacent to the banknote transporting unit, wherein the second sensor is interposed between the banknote transporting unit and the temporary storing section to detect the passage of the discharged banknote into the temporary storing section.

4. The compact banknote dispensing device of claim 3, further comprising:

a dispensing slot for dispensing a predetermined number of discharged banknotes; and a slider member for pushing a predetermined number of discharged banknotes in the temporary storing section out of the temporary storing section to the dispensing slot so that the predetermined number of discharged banknotes protrude out of the dispensing slot.

5. The compact banknote dispensing device of claim 3, wherein the predetermined number of discharged banknotes is four.

6. The compact banknote dispensing device of claim 3, wherein the predetermined number of discharged banknotes is nine.

7. The compact banknote dispensing device of claim 4, further comprising:

a third sensor for detecting the presence of a one or more dispensed banknotes the third sensor outputting a third signal to indicate the presence of one or more banknotes adjacent to the third sensor, the third sensor being adjacent to the dispensing slot to detect the presence of one or more dispensed banknotes protruding out of the dispensing slot; and an alarm emitter for emitting an audible alarm to indicate an error condition, wherein the third signal is asserted to the control unit to enable the control unit to determine if the dispensed banknotes have been taken by a user, the control unit determining if the banknotes have not been taken by a user for a predetermined amount of time indicates an error condition.

8. The compact banknote dispensing device of claim 7, wherein the first sensor, the second sensor, and the third sensor are a transmitting photoelectric sensor, a reflecting photoelectric sensor or mechanical sensor.

9. The compact banknote dispensing device of claim 1, wherein the banknote storing section and the rejected banknote storing section comprise a removable safe unit.

10. The compact banknote dispensing device of claim 1, wherein the number of radial projections protruding from the peripheral surface of each of the first roller and the first pressing roller is six.

11. The compact banknote dispensing device of claim 1 further comprising:

a fourth sensor for detecting the presence of a banknote adjacent the fourth sensor, the fourth sensor outputting a fourth signal to indicate successful passage of the received banknote through an intermediate position of the banknote transporting unit, the intermediate position being along the transporting path at a distance from the first sensor which is less than the length of an acceptable discharged banknote.

12. The compact banknote dispensing device of claim 11, further comprising:

a fifth sensor for detecting the presence of a banknote adjacent the fifth sensor, the fifth sensor outputting a fifth signal to indicate successful passage of the received banknote to the rejected banknote storing section.

13. The compact banknote dispensing device of claim 12, wherein the fourth sensor and the fifth sensor are a transmitting photoelectric sensor, a reflecting photoelectric sensor, or mechanical sensor.

14. The compact banknote dispensing device of claim 11, wherein the first signal is detecting while the fourth signal becomes detecting after which the first signal becomes non-detecting, the control unit measuring the time difference from the fourth sensor detecting and the first sensor non-detecting in order to measure the length of the discharged banknote.

15. A compact banknote dispensing device, comprising:

a banknote supply storing section for storing one or more banknotes;

a banknote discharging unit for discharging a banknote from the banknote supply storing section at a first predetermined speed, the banknote discharging unit being adjacent to the banknote supply storing section;

a banknote transporting unit for receiving a discharged banknote from the banknote discharging unit and transporting the discharged banknote at a second predetermined speed from the banknote supply storing section, the second predetermined speed being faster than the first predetermined speed, wherein the banknote transporting unit includes a first roller and a first pressing roller disposed adjacent to the banknote supply storing section, the first roller and the first pressing roller rotating oppositely and being arranged so their axes of rotation are parallel to each other to conduct a discharged banknote between the first roller and the first pressing roller in a direction away from the banknote discharging unit, the first roller and first pressing roller having multiple radial projections on the peripheral surface of each roller with one or more intermediate radial projection free portions, the radial projections on the first roller being interposed with the radial projections of the first pressing roller to enable the first roller and the first pressing roller to retain and conduct a discharged banknote in a wave-like manner;

a rejected banknote storing section adjacent to the banknote transporting unit;

a diverting unit for diverting a banknote from a first path to a second path, the first path being the normal banknote discharge path, the second path being the rejected banknote storage path; and a first sensor for detecting the presence of a banknote received by the banknote transporting unit, the first sensor outputting a first signal to indicate the presence of the banknote adjacent to the first sensor;

a second sensor for detecting the presence of a banknote discharged by the banknote transporting unit, the second sensor outputting a second signal to indicate the presence of the banknote adjacent to the second sensor;

a control unit for receiving and processing the first signal and the second signal, the control unit comparing the first signal with the second signal to determine whether a banknote has successfully passed through the banknote transporting unit;

a dispensing slot for dispensing a predetermined number of discharged banknotes;

a slider member for pushing a predetermined number of discharged banknotes in the temporary storing section out of the temporary storing section to the dispensing slot so that the predetermined number of discharged banknotes protrude out of the dispensing slot;

a third sensor for detecting the presence of one or more dispensed banknotes, the third sensor outputting a third signal to indicate the presence of one or more banknotes adjacent to the third sensor, the third sensor being adjacent to the dispensing slot to detect the presence of one or more dispensed banknotes protruding out of the dispensing slot;

a fourth sensor for detecting the presence of a banknote adjacent the fourth sensor, the fourth sensor outputting a fourth signal to indicate successful passage of the received banknote through an intermediate position of the banknote transporting unit, the intermediate position being along the transporting path at a distance from the first sensor which is less than the length of an acceptable discharged banknote, wherein the first signal and the fourth signal are passed to the control unit, the control unit interpreting the first signal and the fourth signal detecting and non-detecting states to determine the length of the transported discharged banknote, the control unit activating the diverting unit to the non-diverting position when the discharged banknote length is within predetermined acceptable parameters, and wherein the banknote transporting unit includes a guiding unit for extending the travel path in a non-planar manner between the first and the fourth sensors to enable the banknote to be accurately measured while reducing the longitudinal length of the dispensing device.

16. The compact banknote dispensing device of claim 15 further comprising:

a temporary storing section for receiving a predetermined number of discharged banknotes, the temporary storing section being arranged adjacent to the banknote transporting unit, wherein the second sensor is interposed between the banknote transporting unit and the temporary storing section to detect the passage of the discharged banknote into the temporary storing section.

17. The compact banknote dispensing device of claim 15, further comprising:

a fifth sensor for detecting the presence of a banknote adjacent the fifth sensor, the fifth sensor outputting a fifth signal to indicate successful passage of the received banknote to the rejected banknote storing section.

18. The compact banknote dispensing device of claim 15, wherein the banknote storing section and the rejected banknote storing section comprise a removable safe unit.

19. A compact banknote dispensing device, comprising:

a banknote supply storing section for storing one or more banknotes;

a banknote discharging unit for discharging a banknote from the banknote supply storing section at a first predetermined speed, the banknote discharging unit being adjacent to the banknote supply storing section;

a banknote transporting unit for receiving a discharged banknote from the banknote discharging unit and transporting the discharged banknote at a second predetermined speed from the banknote supply storing section, the second predetermined speed being faster than the first predetermined speed, wherein the banknote transporting unit includes a first roller and a first pressing roller disposed adjacent to the banknote supply storing section, the first roller and the first pressing roller rotating oppositely and being arranged so their axes of rotation are parallel to each other to conduct a discharged banknote between the first roller and the first pressing roller in a direction away from the banknote discharging unit, the first roller and first pressing roller having multiple radial projections on the peripheral surface of each roller with one or more intermediate radial projection free portions, the radial projections on the first roller being interposed with the radial projections of the first pressing roller to enable the first roller and the first pressing roller to retain and conduct a discharged banknote in a wave-like manner;

a rejected banknote storing section adjacent to the banknote transporting unit;

a diverting unit for diverting a banknote from a first path to a second path, the first path being the normal banknote discharge path, the second path being the rejected banknote storage path; and a first sensor for detecting the presence of a banknote received by the banknote transporting unit, the first sensor outputting a first signal to indicate the presence of the banknote adjacent to the first sensor;

a second sensor for detecting the presence of a banknote discharged by the banknote transporting unit, the second sensor outputting a second signal to indicate the presence of the banknote adjacent to the second sensor;

a control unit for receiving and processing the first signal and the second signal, the control unit comparing the first signal with the second signal to determine whether a banknote has successfully passed through the banknote transporting unit;

a dispensing slot for dispensing a predetermined number of discharged banknotes;

a third sensor for detecting the presence of one or more dispensed banknotes, the third sensor outputting a third signal to indicate the presence of one or more banknotes adjacent to the third sensor, the third sensor being adjacent to the dispensing slot to detect the presence of one or more dispensed banknotes protruding out of the dispensing slot;

a fourth sensor for detecting the presence of a banknote adjacent the fourth sensor, the fourth sensor outputting a fourth signal to indicate successful passage of the received banknote through an intermediate position of the banknote transporting unit, the intermediate position being along the transporting path at a distance from the first sensor which is less than the length of an acceptable discharged banknote, wherein the first signal and the fourth signal are passed to the control unit, the control unit interpreting the first signal and the fourth signal detecting and non-detecting states to determine the length of the transported discharged banknote, the control unit activating the diverting unit to the non-diverting position when the discharged banknote length is within predetermined acceptable parameters, wherein the banknote transporting unit includes a guiding unit for extending the travel path in a non-planar manner between the first and the fourth sensors to enable the banknote to be accurately measured while reducing the longitudinal length of the dispensing device, and wherein the banknote storing section and the rejected banknote storing section comprise a removable safe unit.

* * * * *